United States Patent [19]

Smith, III et al.

[11] 4,337,460

[45] Jun. 29, 1982

[54] HAND-HELD SOUND EFFECTS DEVICE

[75] Inventors: Jay Smith, III, Pacific Palisades; Jeffrey M. Moskin, Los Angeles, both of Calif.

[73] Assignee: Smith Engineering, Santa Monica, Calif.

[21] Appl. No.: 115,356

[22] Filed: Jan. 25, 1980

[51] Int. Cl.[3] ..... G08B 3/10

[52] U.S. Cl. ..... 340/384 E; 340/384 R

[58] Field of Search ..... 340/384 E, 384 R; 331/107, 117

[56] References Cited

U.S. PATENT DOCUMENTS

| | | | |
|---|---|---|---|
| 3,594,786 | 7/1971 | Brunner-Schwer | 340/384 |
| 3,707,716 | 12/1972 | Goralnick | 340/384 |
| 3,718,987 | 3/1973 | Carvier | 340/384 |
| 3,795,873 | 3/1974 | Fein | 340/384 |
| 3,971,016 | 7/1976 | Pui | 340/384 E |
| 4,023,078 | 5/1977 | Olliges | 340/384 |
| 4,086,589 | 4/1978 | Cieslak | 340/384 E |
| 4,101,885 | 7/1978 | Blum | 340/384 E |
| 4,135,146 | 1/1979 | Krupp | 340/384 E |
| 4,149,257 | 4/1979 | Nakagiri | 340/384 E |

*Primary Examiner*—Harold I. Pitts

*Attorney, Agent, or Firm*—Jackson, Jones & Price

[57] ABSTRACT

A hand-held electronic sound generator, comprising a one or more oscillators and a noise generator, each acting singly, mixed or gated in combination to produce a variety of interesting sounds. The device may be operated continuously or as a momemtary pulse with decaying volume. Power is used only when sounds are being generated to conserve battery power. The frequency of the oscillators or noise generator may be varied to change the characteristics of each individual sound combination.

1 Claim, 1 Drawing Figure

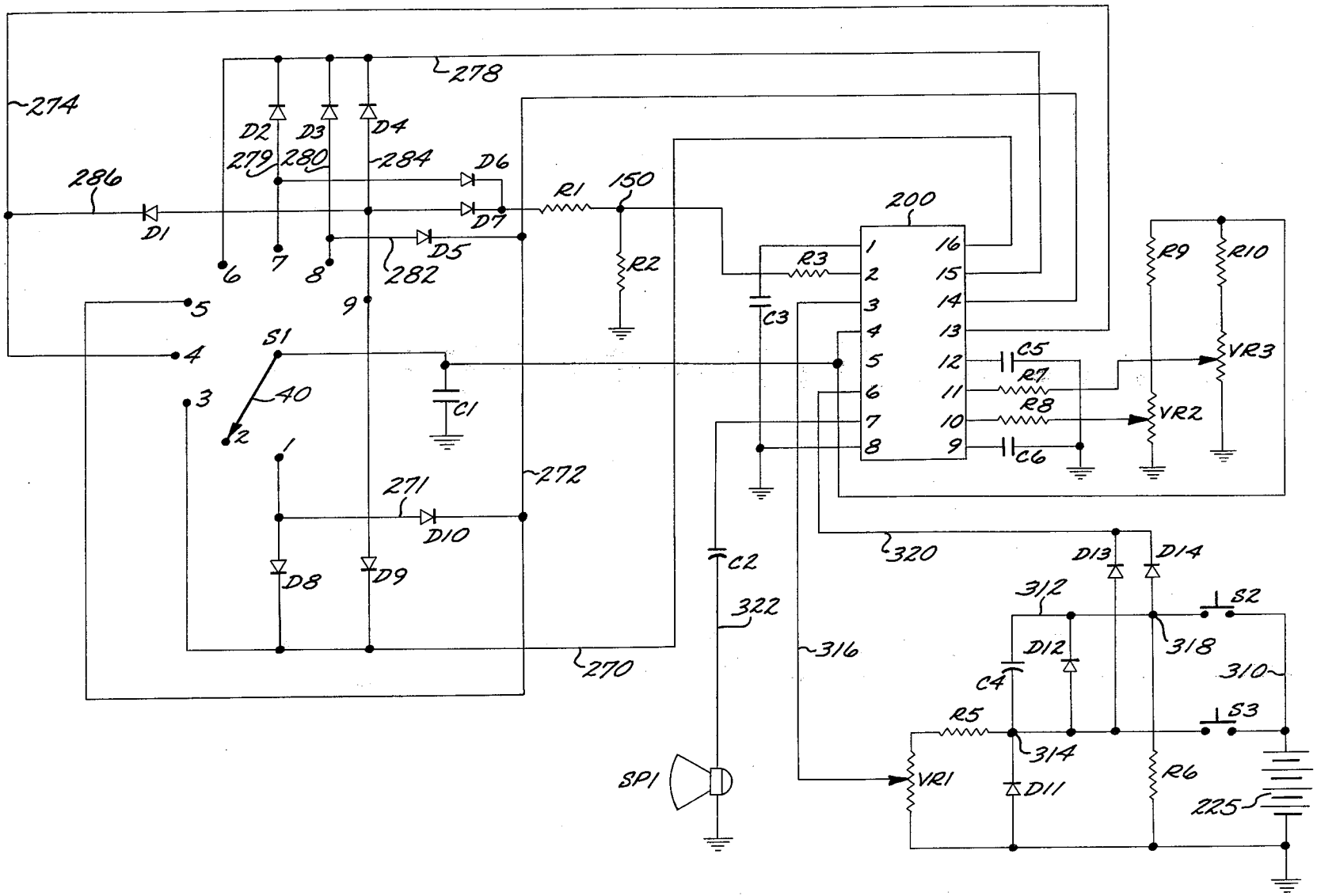
R10
VR3
R9
VR2
C5
R7
R8
C6
200
16 15 14 13 12 11 10 9
1 2 3 4 5 6 7 8
R3
C3
C2
322
SP1
320
316
S2
310
S3
225
D14
318
R6
D13
312
D12
314
D11
C4
R5
VR1
150
R2
R1
272
270
278
D6
D7
D5
282
C1
D10
271
D9
D4
284
9
D3
280
8
D2
279
7
6
S1
40
1
2
D8
5
4
3
D1
286
274

HAND-HELD SOUND EFFECTS DEVICE

BACKGROUND OF THE INVENTION

1. Field of the Invention

The field of the present invention is sound effect production, and more particularly to hand-held devices for generation of sound effects.

2. Description of the Prior Art

Numerous examples exist in the prior art of electronic apparatus for sound simulation. Exemplary of these are the apparatus described in the following U.S. Pat. Nos.: 3,707,716, issued to Goralnick for a multi-tone push button controlled electronic horn; 3,718,987, issued to Carver for an aircraft sound simulation system; 4,023,078, issued to Olliges et al for a solid-state sound effect generating system for selectively producing any one of a plurality of predetermined sound effects from interchangeable plug-in printed circuit boards; 3,971,016 issued to Pui for an electronic "chirper"; 4,135,146 issued to Krupp for a portable handclap generator; 4,101,885 issued to Blum for a musical chime device; 3,594,786 issued to Brunner-Schiver et al for an electronic apparatus for simulating animal sounds; and 3,795,873 issued to Fein for a multi-channel noise simulator.

While these devices may perform well enough for the applications for which they are intended, none are suited for hand-held use for generating a plurality of interesting sounds. For flexibility in utilization, it is desired to be able to produce a variety of interesting sounds not just one type of sound. The simplicity and portability of the device is another feature which greatly enhances the desireability of the sound generator. If inexpensive and portable, a sound effects generator will find application as an amusement device.

None of the known prior art devices are both portable and capable of generating a variety of interesting sounds.

SUMMARY OF THE INVENTION

A hand-held electronic sound effects device is disclosed. The device includes a generator circuit including a noise generator, voltage controlled oscillator, low frequency oscillator, a mixing circuit for selectively combining two or more of the generators and oscillators. The device further includes an audio amplifier with variable gain selector means for operator control of the mixer, a pitch control for operator control of the voltage controlled oscillator, and an oscillation rate control for the low frequency oscillator. The device further includes two controls for providing power to the circuit, one which is further operative to cause the gain of the audio amplifier to exponentially decay.

BRIEF DESCRIPTION OF THE DRAWINGS

FIG. 1 is a detailed schematic diagram of the circuit of the preferred embodiment.

DETAILED DESCRIPTION OF THE INVENTION

The present invention comprises a hand-held, portable apparatus for generating a plurality of interesting sounds. In its preferred embodiment, the invention utilizes a commercially available integrated circuit having a voltage controlled oscillator ("VCO") low frequency oscillator, noise generator and a mixer for selectably combining these three generated signals. A multi-position switch is utilized to select the type of sound desired to be produced, and pitch and oscillation rate controls are included to control the pitch of the VCO and the oscillation rate of the low frequency oscillator. Two switches are provided to enable power to the apparatus from a battery, one switch allowing continuous operation as long as the switch is actuated, the other switch for momentary enablement of the circuit, with a built-in output volume decay. The power enablement switches are configured so as to conserve battery power.

The novel features which are considered as characteristic for the invention are set forth in particular in the appended claims. The invention itself, however, both as to its construction and operation, together with additional objects and advantages thereof, will be best understood from the following description of the preferred embodiment. Other embodiments carrying out the principles of the subject invention will readily be apparent to those skilled in the art, and the present invention is not intended to be limited to the disclosed embodiment.

While the circuit of the disclosed embodiment utilizes an integrated circuit chip which provides the VCO, low-frequency oscillator, noise generator, audio amplifier and mixers on board the chip, it would of course be possible to replace the integrated circuit with discrete circuitry and components, at the expense of some compactness and additional component expense.

Referring now to FIG. 1, a schematic diagram of the preferred embodiment of the circuit is shown. Operator control of the sound generator is achieved through six controls. Switch S1 is a nine position switch, and may be a slide switch wherein the slider directly contacts appropriately placed conductors of the printed circuit board. This provides a simple and inexpensive multi-position switch.

Switches S2 and S3 are push-button type switches which enable power to the circuit from the battery 225. These switches provide power only when the depressed, preventing wasteful battery drain when the device is not in use.

The fourth, fifth and sixth operator controls are variable resistors VR1, VR2 and VR3. VR1 controls the output audio volume. VR2 controls the pitch of sounds generated by the VCO, while VR3 controls the frequency of oscillation of the low-frequency oscillator.

Integrated circuit chip 200 comprises, in the preferred embodiment, a 16 pin lead masked version of the Texas Instrument complex sound generator chip SN 76488. As described in the data sheet for this chip, the contents of which are incorporated herein by reference, the chip combines both analog and digital circuitry, and includes inter alia a noise generator, a voltage-controlled oscillator, a low-frequency oscillator, together with a noise filter, mixer, audio amplifier, and control circuitry to combine noise, tone, or low-frequency sounds.

Terminal 1 of chip 200 is coupled to ground via capacitor C3 (which may be 680 pf), the noise filter capacitor. Terminal 2 is coupled to noise filter resistor R3 (which may be 33K ohms). Terminal 3 receives an input voltage which determines the level of the audio output.

Terminal 4 of chip 200 provides a regulated 5 volt dc voltage from the input supply voltage received at terminal 6 of chip 200. Terminal 7 is coupled via capacitor C2 to speaker SP1 and provides the output audio signal. In the preferred embodiment, speaker SP1 has an 8 ohm impedance; of course other types of audio transducers may readily be substituted.

Terminals 9 and 10 are coupled to the chip VCO selection components, terminal 9 being coupled to capacitor C6 (which may be 100 pf) and terminal 10 coupled through fixed resistor R8 (which may be 1 megohm) to the voltage divider circuit comprising variable resistor VR2 (with maximum resistance of 1 Megohm) and fixed resistance R9 (360 K ohms). Resistor R9 is coupled to the 5 volt regulated voltage at terminal 4 of chip 200. Hence, by operator adjustment of VR2, the voltage at terminal 10 may be varied between the ground potential and approximately 3 volts.

Similarly, terminals 11 and 12 of chip 200 are connected to the low frequency oscillator components which determine the oscillation rate for the low frequency oscillator. Terminal 11 is connected through R7 (which may be 47K ohms) to a voltage divider network comprising variable resistor VR3 and resistor R10 (360K ohms) to the 5 volt regulated output at terminal 4 of chip 200. As discussed previously with respect to terminal 10, by variation of VR3 the voltage at terminal 11 of chip 200 may be varied from the ground potential to approximately 3 volts.

Terminal 13 is a control terminal for determining whether the VCO is controlled internally by the low frequency oscillator, or externally by the voltage at terminal 10. When the terminal voltage is pulled "high", the external VCO control is selected, and the voltage at terminal 10, selected by VR2, will control the VCO.

Terminals 14, 15 and 16 are the logic control inputs to the mixer which combines in a selectable manner the outputs from the noise generator and two oscillators. As discussed in the data sheet for the Texas Instrument's complex sound generator chip, the mixer performs a logical "AND" function on the selected input signal. The output of the mixer, then, is determined by the logic levels at the mixer logic inputs at terminals 14, 15 and 16 of chip 200.

The operation of the operator controls will now be described. The position of the "slider" 40 of switch S1 determines the function of the apparatus, and in other words, the type of sound generated. The type of sound for each position may of course be varied in accordance with the circuit parameters and by introduction of additional sound generating circuitry, but the preferred embodiment produces the following types of sounds:

| S1 Position | Sound |
|---|---|
| 1. | Helicopter |
| 2. | Siren |
| 3. | Motor |
| 4. | Tone |
| 5. | Train |
| 6. | Gun |
| 7. | Bomb |
| 8. | Chirp |
| 9. | Jet |

The slider 40 of switch S1 is coupled to Terminal 4 of chip 200 which provides the five volt regulated output. Therefore by contacting the respective switch terminals 1 through 9, the terminals are connected to the five volt supply. Certain terminals of switch S1 are variously connected through diodes D1 through D10 to the respective terminals of the chip 200. The diodes prevent spurious high signals from being transmitted to the chip terminals as a result of interconnection of some of the switch terminals.

The operation of the switch S1 is readily apparent from the schematic drawing of FIG. 2 and will only be briefly described. With the slider 40 contacting terminal 1 of switch S1, terminal 16 of the chip is pulled high via line 270, and chip terminal 14 is pulled high via lines 271 and 272. In this position, the device will produce a "helicopter" whirring sound, the pitch and speed of which are adjustable by operator control of variable resistors VR2 and VR3 respectively (combination of noise, VCO and low frequency oscillator).

In the preferred embodiment, switch S1, position 2 is open, producing a siren-like sound from the VCO.

When in position 3, the switch S1 couples the high voltage to terminal 16 of chip 200, producing a "motor" sound (only the low frequency oscillator output).

When in position 4, terminal 13 of the chip 200 is pulled "high" via line 274. When in position 4, the generator produces a tone, whose pitch may be varied by VR2.

When in position 5, terminal 14 only is pulled "high" via line 272. When in position 5, a "train" engine noise is produced; this is a noise tone modulated by the low frequency oscillator which may be varied in rate via variable resistor VR3.

When in position 6, switch S1 pulls terminal 15 of the chip 200 "high" via line 278. When in this configuration, a "gun shot" high pitched noise is produced (noise generator only).

When in position 7, switch S1 pulls terminal 15 high via lines 279 and 278, and also pulls up the voltage at node 150 of the voltage divider comprising R1 (4.7K ohms) and R2 (6.8K ohms). The voltage divider is coupled to the noise filter resistor R3. For high pitched sounds, the voltage at node 150 should be near ground potential, and for low pitched sounds, the voltage at node 105 must be higher. When the switch is in position 7 low pitch "bomb" noise will be produced.

When in position 8, terminal 15 of chip 200 is pulled "high" via lines 278 and 280, and terminal 14 is pulled high via lines 280, 282 and 272. In this mode, a "chirp" sound is produced, as the output is the mixed VCO and low-frequency oscillator output.

When in position 9, terminal 15 is pulled high via lines 284 and 278, terminal 13 is pulled high via lines 284, 286 and 274, and node 150 is pulled high via D7 and line 284. In this mode a "jet" engine noise is produced which is the combination of a tone and low pitch noise.

Another novel feature of the circuit of the present embodiment is the use of switch S2 in conjunction with a voltage decay circuit to provide a control signal for causing the volume of the audio output signal to decay from a preset initial volume to zero. Switches S2 and S3 are push-button type switches which couple the battery 225 to the circuit.

One side of switch S2 is connected to battery 25 by line 310. The other side of the switch S2 is connected to the anode of capacitor C4 by line 312. The cathode of capacitor C4 is connected to node 314. Coupled to node 314 are resistor R5, the cathode of diode D11, the anodes of diodes D12 and D13, and one side of switch S3. Resistor R5 is also coupled to variable resistor VR1. Line 316 couples VR1 to terminal 4 of chip 200.

Diodes D13 and D14 couple S3 and S2 respectively to terminal 6 of the chip 200, which terminal receives the input power required to operate the chip 200. Thus when either or both of switches S2 or S3 are closed, voltage is applied from the battery 225 to the chip.

The voltage at terminal 3 of the chip determines the volume of the output audio signal applied to speakers SP1 from terminal 7 via line 322. That voltage is determined by the resistance values of R5 and VR1 which together comprise a voltage divider, and the voltage level applied to node 314. When S3 is closed, the battery voltage is applied directly to node 314. Hence the voltage level applied to terminal 3 will depend upon the shaft position of variable resistance VR1.

When switch S2 only is closed, the battery voltage is coupled to node 314 by capacitor C4 ( which may be 4.7 microfarads in the preferred embodiment). The voltage at node 314 will therefore initially be the battery voltage, but will decay exponentially to zero at a rate determined by the capacitance of C4 and the combination of R5 in series with VR1.

In essence, the voltage applied to terminal 3 of chip 200 is a control signal which is operative to control the gain of the amplified chip audio output signal at terminal 7. For the disclosed embodiment, a voltage of about 3.5 volts will provide the maximum output level, while voltages below approximately 0.4 volts will result in zero audio output.

While no circuitry is disclosed for the amplifier portion of chip 200, alternate embodiments using discrete audio amplifier sections controlled by a gain control signal will be readily apparent to those skilled in the art.

Another advantage of the use of push-button switches S2 and S3 is that the battery voltage is applied to the chip only when one of the switches is closed. Since this type of switch remains closed only so long as the operator depresses the push button, the unit may not inadvertently be left in the "power on" state by the operator, thereby conserving battery power.

There has been described a novel hand-held sound effects device which is capable of generating a variety of interesting sounds. A noise generator, voltage controlled oscillator, low frequency oscillator and audio amplifier and controlled by the operator to vary the pitch and oscillation rate of the oscillators and vary the audio output level. The oscillators and noise generators are mixed together in a selectable manner in accordance with another operator control. One of the primary novel aspects of the present invention lies in the capability for the operator to effectively and completely control the operation of the device to produce a sound of the desired type from a variety of possible sounds available.

Alternate embodiments of the invention will readily appear to those skilled in the art. The circuit could be fabricated from all discrete components, instead of using an integrated circuit. Further, the types of sounds generated may of course be varied by appropriate selection of the component values.

What is claimed is:

1. A circuit for generating a plurality of sounds in dependance on operator control, powered by an electrical power source and comprising:

audio signal generator means including noise generator, low frequency audio oscillator, voltage controlled oscillator and mixing means for mixing the outputs of the noise generator, low frequency oscillator and voltage controlled oscillator;

amplifier means for amplifying the output of said audio signal generator;

sound selector means coupled to said mixing means, said selector means adapted for operator selection of the respective ones of said noise generator and said oscillators to be mixed;

pitch control means coupled to said voltage controlled oscillator, adapted for operator control of the pitch of said voltage controlled oscillator;

oscillation rate control means coupled to said low frequency oscillator, adapted for operator control of the oscillation rate of said low frequency oscillator; and audio transducer means coupled to the audio output of said audio amplifier means; all of said above means adapted for inclusion in a housing to be hand-held by operator, the sound generating circuit further comprising switch means for coupling such electrical power source to the circuit, said switch adapted to provide power to the circuit only when held in a closed position by the operator.

* * * * *